US007100473B2

(12) United States Patent
Hefti et al.

(10) Patent No.: US 7,100,473 B2
(45) Date of Patent: Sep. 5, 2006

(54) ROTATING CAP OPENER

(75) Inventors: Rolf Hefti, Cugnasco (CH); Walter Ruffner, Malenfeld (CH)

(73) Assignee: Heftitec SA, Cugnasco (CH)

( * ) Notice: Subject to any disclaimer, the term of this patent is extended or adjusted under 35 U.S.C. 154(b) by 0 days.

(21) Appl. No.: 10/943,099

(22) Filed: Sep. 17, 2004

(65) Prior Publication Data

US 2005/0028646 A1 Feb. 10, 2005

Related U.S. Application Data

(63) Continuation of application No. PCT/CH02/00163, filed on Mar. 19, 2002.

(51) Int. Cl.
*B67B 7/14* (2006.01)
*B67B 7/18* (2006.01)

(52) U.S. Cl. ..... 81/3.4; 81/3.42; 81/3.36

(58) Field of Classification Search ..... 81/3.42, 81/3.4, 3.36, 3.43, 3.44, 64
See application file for complete search history.

(56) References Cited

U.S. PATENT DOCUMENTS

| | | | | |
|---|---|---|---|---|
| 1,394,388 | A * | 10/1921 | Wisenberg et al. | 81/3.42 |
| 2,524,434 | A | 10/1950 | Duket | |
| 2,565,212 | A | 8/1951 | Drazick | |
| 2,931,258 | A * | 4/1960 | Ronning, Jr. | 81/3.44 |
| 3,600,982 | A * | 8/1971 | Tholen | 81/3.4 |
| 4,085,632 | A | 4/1978 | Hogan et al. | |
| 5,083,482 | A * | 1/1992 | Floyd | 81/3.44 |
| D348,814 | S * | 7/1994 | Pearson | D8/51 |
| 6,142,039 | A * | 11/2000 | Herring, Sr. | 81/3.2 |

FOREIGN PATENT DOCUMENTS

| | | |
|---|---|---|
| DE | 1 960 098 | 6/1971 |
| FR | 2 750 688 | 1/1998 |
| GB | 2 227 968 | 8/1990 |

* cited by examiner

*Primary Examiner*—Lee D. Wilson
*Assistant Examiner*—Alvin J. Grant
(74) *Attorney, Agent, or Firm*—Buchanan Ingersoll & Rooney

(57) ABSTRACT

A screw lid opener is disclosed which can be converted in an extremely simple manner from one lid radius to another With a screw lid opener having a lever-like handle with a clamping device thereon for holding a screw lid, the lid radius is set by three clamping cheeks for clamping on a screw lid. The clamping jaws are arranged at a distance from a center between the clamping jaws. In accordance with exemplary embodiments, at least one clamping jaw, whose distance from the center can be changed, is provided. This permits the conversion from one lid radius to another. Advantageously all three clamping jaws are embodied to be movable in the same way. With the same spectrum at various radii of lids, this results in a shorter travel for the individual clamping jaw.

11 Claims, 5 Drawing Sheets

ROTATING CAP OPENER

CROSS REFERENCE TO RELATED APPLICATIONS

This application claims priority as a continuation application under 35 U.S.C. §120 to PCT/CH02/00163 filed as an International Application on 19 Mar. 2002 designating the U.S., the entire contents of which are hereby incorporated by reference in their entireties.

BACKGROUND

A kitchen tool is disclosed for opening screw lids of containers, such as jars and bottles.

Often, screw lids are hard to open, in particular for older people. The force needed for opening is not available to some. The required friction between the hand and the rim of the lid can often not be achieved without aids.

Therefore attempts have been made to create a screw lid opener, with the aid of which even children and oldsters can unscrew a lid from a vacuum-packed jar of preserves, for example.

However, the conversion of known screw lid openers to a different radius of the screw lid is relatively complicated, so that children and women in particular avoid their use.

SUMMARY

A screw lid opener is disclosed which can be converted in an extremely simple manner from one lid radius to another.

With a screw lid opener having a lever-like handle with a clamping device thereon for holding a screw lid, the lid radius is set by three clamping cheeks for clamping on a screw lid. The clamping jaws are arranged at a distance from a center between the clamping jaws. In accordance with exemplary embodiments, at least one clamping jaw, whose distance from the center can be changed, is provided. This permits the conversion from one lid radius to another. Advantageously all three clamping jaws are embodied to be movable in the same way. With the same spectrum at various radii of lids, this results in a shorter travel for the individual clamping jaw.

In this case, the movable clamping jaw is usefully arranged on a movable clamping jaw support, which is movably seated on a guide disk. Advantageously the clamping jaw support works together with a displacement disk, which can be turned in respect to the guide disk in such a way, that the distance of the clamping jaw from the center can be changed by means of a relative rotation between the displacement disk and the guide disk. Such a rotating movement is easily performed, so that even people who are clumsy in technical matters can perform the adaptation of the screw lid opener to a defined radius of the screw lid.

For performing the rotating movement, a rotary handle can be connected with the displacement disk, or two handles, which can be pivoted in the manner of tongs in respect to each other, can be provided at the handle, whose relative movement, for example via a gear wheel drive, results in a relative movement between the guide disk and the displacement disk.

The displacement disk can be connected with the handle, and the guide disk could be embodied to be rotatable in relation to the handle, or the opposite embodiment can be implemented. Therefore the guide disk is advantageously connected with the handle. By means of this a force can be transferred to the clamping jaws via the guide disk for unscrewing a screw lid.

The clamping jaw support can be advantageously guided linearly in a guide rail on the guide disk. However, it can also be pivotably hinged to the guide disk.

If the pivot element is hinged on the guide disk, the clamping jaw can be arranged on a toothed pivot element. The teeth of the pivot element are in engagement with the teeth of a gear wheel of the displacement disk. However, a guide element can also be provided on the clamping jaw support, which engages a helical guide element at the displacement disk. This permits a design wherein the clamping jaw support is adjustable, as well as such a one wherein it is translatorily displaceable.

With a helical guide element it is possible to provide that the guide elements of several clamping jaw supports engage the same helical guide element. This permits a stronger embodiment of the groove walls of the helical guide element. However, for bringing the three clamping jaws uniformly together, a separate helical guide element is advantageously provided for each movable clamping jaw support.

So that the displacement disk does not rotate in order to yield to the force of the action of the clamping jaws being pushed apart in the course of opening a lid, the gradient of the helix may not exceed a maximum gradient. If the helical guide element is guided at uniform distances from the adjoining turns of the helix, the gradient of the helical guide element decreases from the inside to the outside. So that the number of revolutions of the displacement disk for changing the clamping jaws from the smallest to the greatest radius is as small as possible, the helical guide devices are not guided with the smallest possible gradient from the inside to the outside. In spite of this, the gradient is advantageously less on the outside than on the inside. Since the lid diameters are standardized, the helical guide element can be flatter in the areas in which the clamping jaws have a suitable distance from the center for being able to grip a defined lid radius. No jamming between the guide element and the helical guide element need occur in the other areas, since they only need to be traversed for getting from one standard lid radius to the next. In this connection it is advantageous not to lay out the gradient to be constant.

BRIEF DESCRIPTION OF THE DRAWINGS

The invention will now be represented in greater detail by way of exemplary embodiments. The exemplary embodiments are represented in the drawings which, however, should not be considered to be limiting. Shown are in.

DETAILED DESCRIPTION

Figure 1:
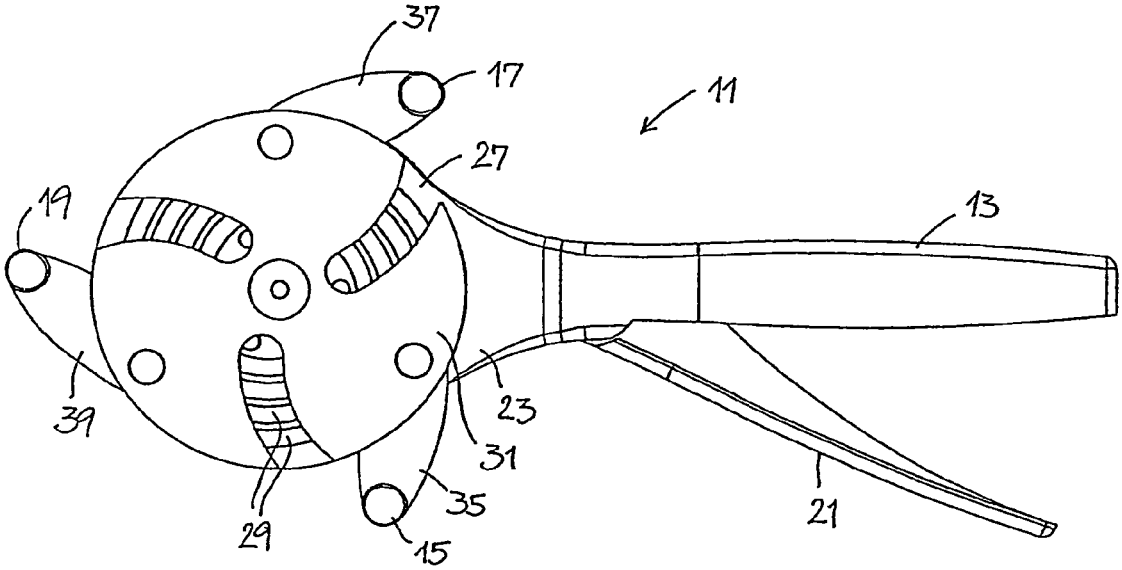
FIG. 1, a plan view of an exemplary lid opener with pivotable clamping jaws.
Figure 2:
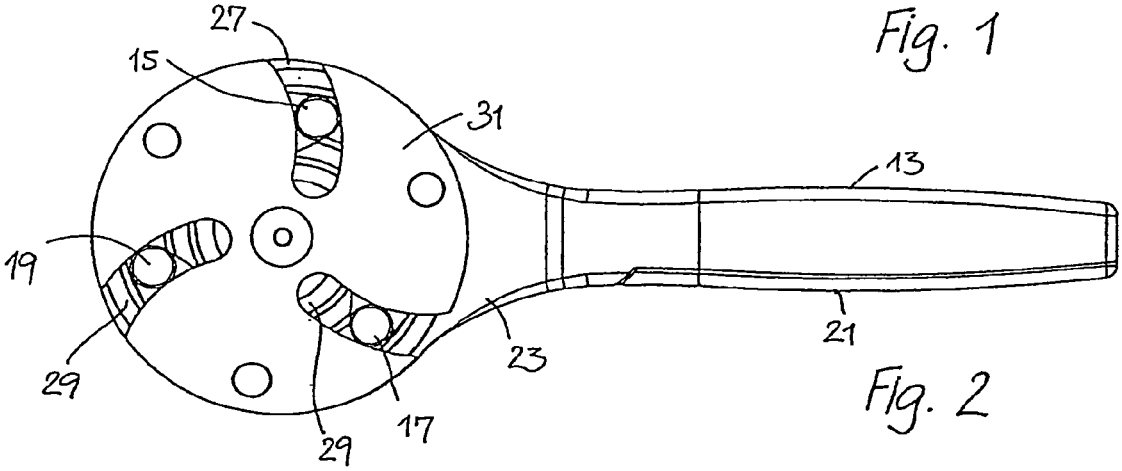
FIG. 2, the same plan view as in FIG. 1, but with the clamping jaws in a narrower position.
Figure 3:
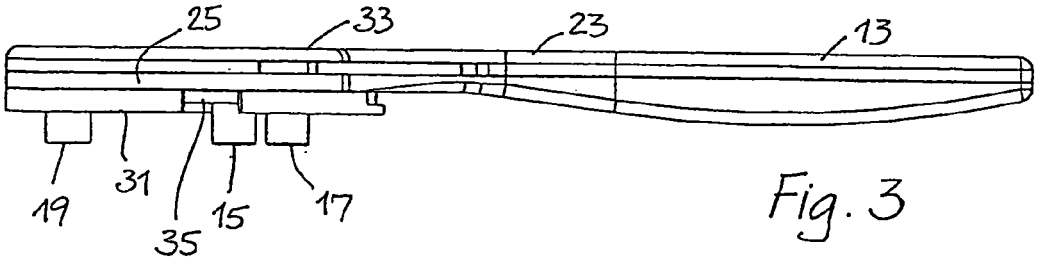
FIG. 3, a lateral view of the lid opener in FIG. 2.

A lid opener 11 in accordance with an exemplary embodiment of the invention is represented in FIGS. 1 and 2. It has a handle 13 for turning a lid held in the lid opener and three clamping jaws 15, 17, 19. The handle 13 is a part of a base element 23. The handle 13 moreover includes a lever 21, hinged on the base element 23. Following the handle 13, the base element 23 makes a transition into a support disk 25 (see FIG. 3). The support disk 25 is a displacement disk 27 at the same time. For adjusting the clamping jaws, it has three helical guide elements 29 on its front. A guide disk 31 arranged in front of it is seated on the displacement disk 27 in the center of the helical guide elements 29, and its shaft passes through the support disk 25. A gear wheel is arranged on the shaft behind the support disk. On the far side of its hinge point, the lever 21 has a tooth arrangement which acts together with the gear wheel tooth arrangement of the guide disk 31. In this way it is possible by pivoting the lever 21 to rotate the guide disk 31 in relation to the helical guide elements 29, which results in a displacement of the clamping jaws.

In another embodiment, the displacement disk 27 has the helical guide elements on its front, and on its back a gear wheel, which can be actuated by the handle. In this case the displacement disk 27 is rotatably seated on the support disk 25, and the guide disk 31 is connected with the displacement disk in a manner fixed against relative rotation.

However, in the represented case, the guide disk 31 is turned in relation to the displacement disk 27 when the lever 21 is actuated—as represented by the difference between FIGS. 1 and 2—. In FIG. 1, the lever projects at an angle away from the handle, and the clamping jaws are in a position wherein they are remote from each other, in which the largest possible circle can be covered. In FIG. 2, the lever 21 has been pivoted into a position parallel with the handle 13, and the clamping jaws 15, 17, 19 are in a position closer to each other, in which only a small circle can be covered. The gear wheel connection between the lever 21 and the guide disk 31 is covered by a cover 33.

Three pivot levers 35, 37, 39 are hinged to the guide disk 31. Each pivot lever has a clamping jaw 15, 17, 19, which projects past the guide disk 31 toward the front. On the other side, each of the pivot levers 35, 37, 39 has a guide element, for example a bolt, which engages the helical guide element 29 (see, e.g., FIG. 6). Upon a relative rotation between the helical guide element 29 and the guide disk 31, these guide elements are pivoted in the helical guides around the center of rotation of the pivot lever, and at the same time are forcibly moved away from the center of rotation or toward the center of rotation. The clamping jaws 15, 17, 19 are correspondingly pivoted together with the pivot levers.

Figure 4:
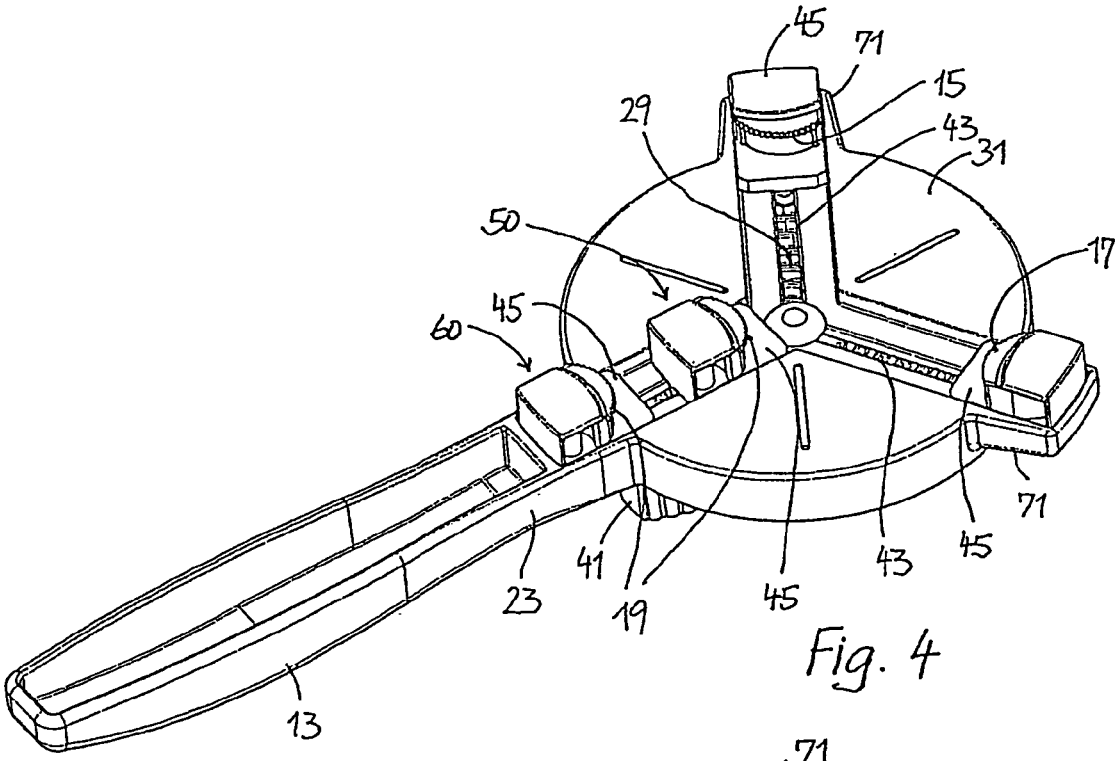
FIG. 4, a perspective plan view of an exemplary embodiment with three displaceable clamping jaws.
Figure 5:
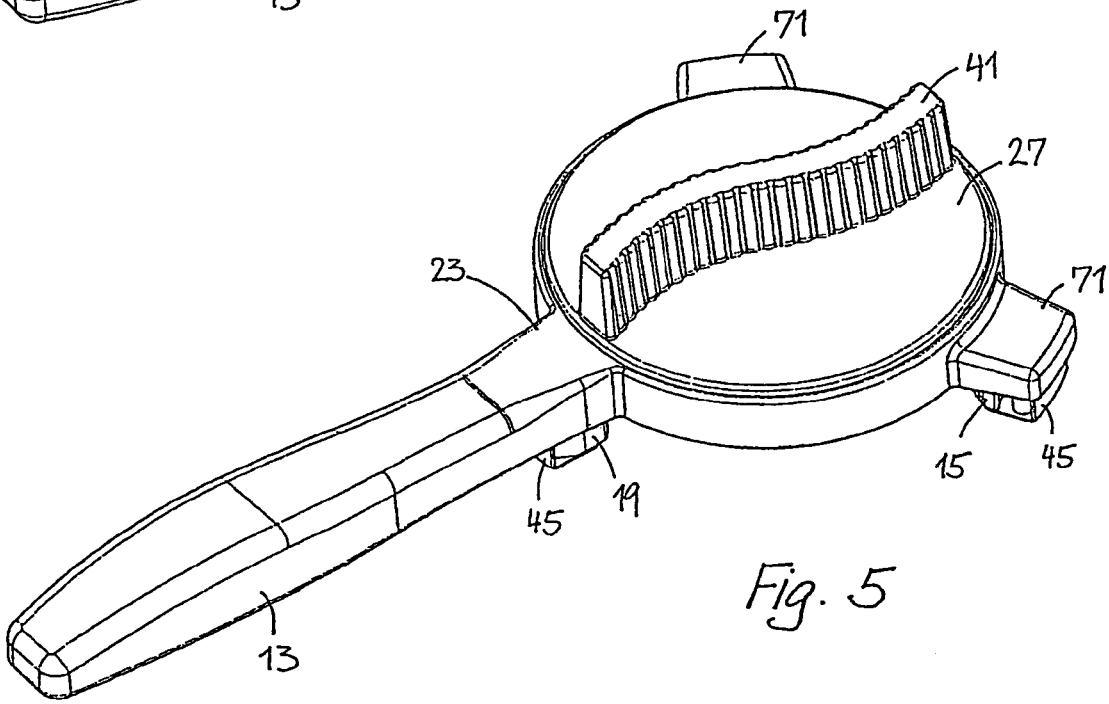
FIG. 5, a perspective plan view of the lid opener in accordance with FIG. 4, but viewed from the opposite side.

An exemplary embodiment is represented in FIGS. 4 to 11. FIG. 4 shows it from below. In FIG. 4, the clamping jaw 19 with the support element 45 is represented twice, namely in an outermost position 60 and an innermost position 50. FIG. 5 shows the same exemplary embodiment from the top. The base element 23 is made of one piece together with a handle 13. In contrast to the base element of the first exemplary embodiment, the base element 23 constitutes the guide disk 31. A displacement disk 27 is rotatably seated on it. The displacement disk 27 is provided with the rotatable handle 41, which is connected, fixed against relative rotation, with the displacement disk 27 (FIG. 5).

The guide disk 31 has three radial guide slits 43, which are connected with each other at the center. A support element 45 of the clamping jaws 15, 17, 19 is seated in each guide slit 43.

Each support element 45 (FIGS. 10 and 11), has a retaining plate 47, with which it extends behind the edge of the guide slit 43. The connecting point of the three guide slits in the center has been widened in such a way (FIG. 7), that the retaining plates 47 can be pushed through the guide disk 31 at the connecting point. But the guide slits 43 themselves are less wide than the retaining plate 47.

A bolt 49 projects from the retaining plate 47, with which the support element 45 engages a helical guide element 29 in the displacement disk 27. The support element 45 moreover has a translatory guide 51, which is guided between the edges of the guide slit 43, and a sliding plate 53 which rests on the guide path of the guide disk 37. The clamping jaws 15, 17, 19 lie above the guide disk. The clamping jaws can snap into a holding column 55 at the support element 45.

Figure 6:
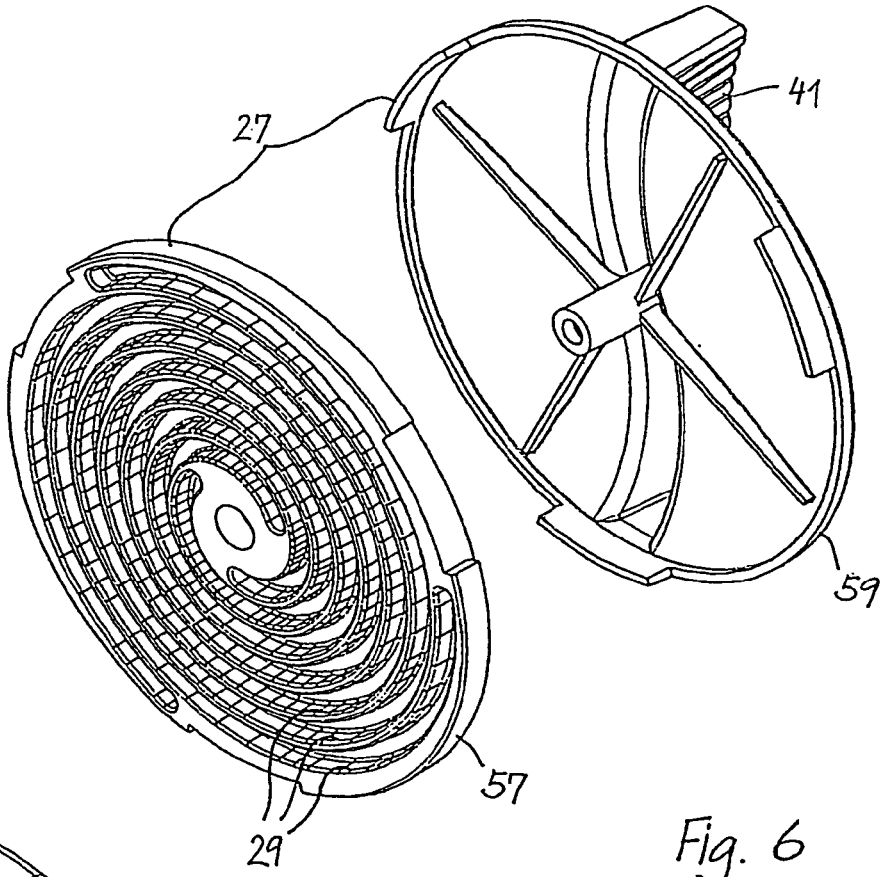
FIG. 6, a perspective representation of the displacement disk with helical track and rotating handle.

Back to FIG. 6, in which the displacement disk 27 is represented. The displacement disk 27 has been put together from a helical guide disk 57 and a rotary grip disk 59. Three concentric helical guide elements 29 have been formed in the helical guide disk 57. Each helical guide element 29 is a helical groove. Thus, the three grooves alternatingly lie next to each other radially. The three helical guide elements are identical and are only arranged turned by 120 degrees in respect to each other. The lead of the represented helical turns is of the same size for an identical angular change. This has the result that the gradient of the helical guide element 29 decreases from the inside to the outside. However, the gradient can also be uniform, so that the lead increases from the inside to the outside. The gradient is advantageously decreasing and the lead increasing.

Figure 12:
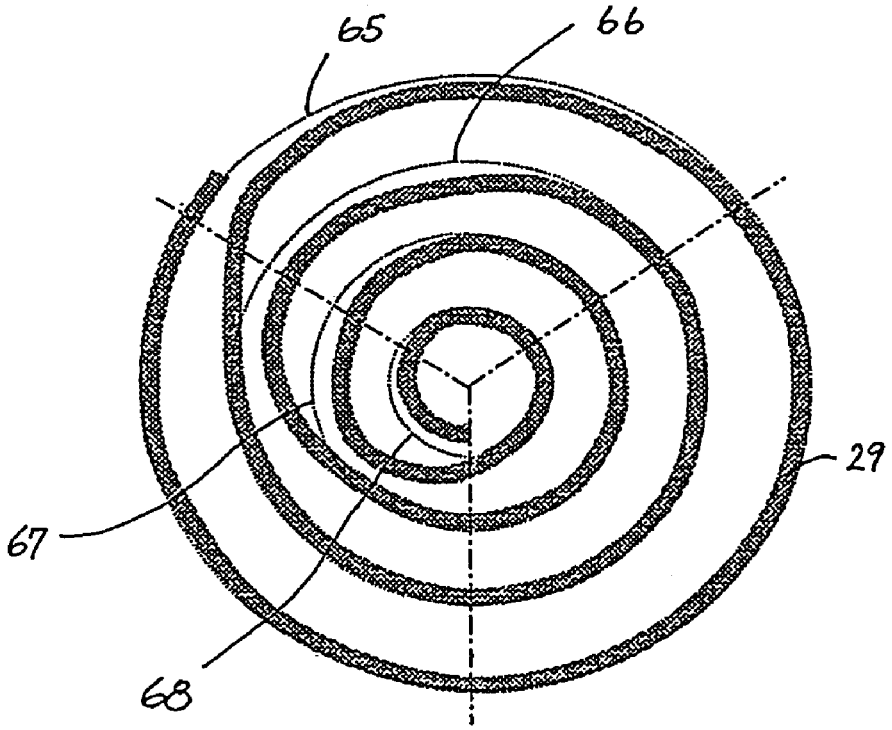
FIG. 12, an exemplary embodiment of the helical guide element.

Alternatively, there can also only be a single helical guide element 29 (FIG. 12), which is engaged by all three support elements 45. Advantageously, in the areas where the clamping jaws are arranged at a distance suitable for a standard screw lead dimensions (broken circular lines 65, 66, 67, 68), the guide element has a small gradient, and in the transition area from one lid diameter to the other a substantially greater gradient. As represented in FIG. 12, the lead of the helical guide element can be practically equal to zero over 240 degrees. Over the adjoining 90 degrees it can increase sufficiently so that one of the three clamping jaws 15, 17, 19 is moved sufficiently far toward the center so that clamping is achieved. The remaining 30 degrees are used for the transition to the next lid sizes. However, the transition area can also include more than 30 degrees, so that the areas with very small gradients are turned in respect to each other. No self-locking between the helical guide element 29 and the bolt 49 is required in the transition areas between the standard lid sizes. Therefore the lead can be of arbitrary size in this area.

A similar stepping of the spiral guide element 29 is also possible with three spiral guide elements.

Figure 7:
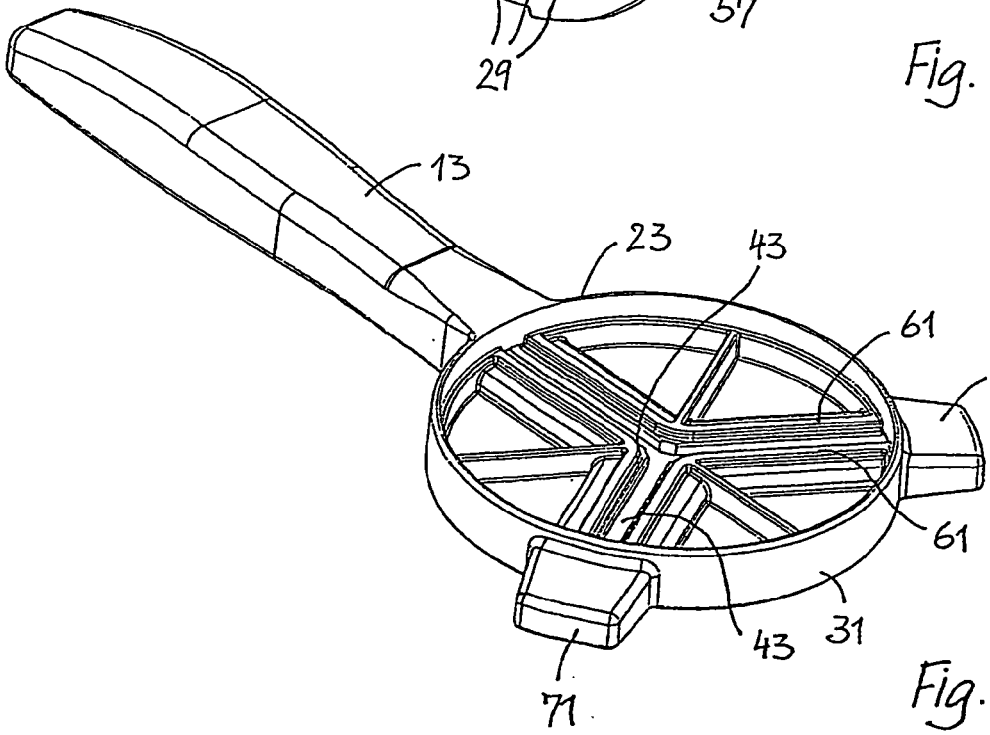
FIG. 7, a perspective representation of an exemplary base element with the guide disk and handle.

FIG. 7 shows that the handle 13 and the guide disk 31 together constitute the base element 23. The guide disk 31 is circular and has the three guide slits 43 for the support elements 45. The translatory guides 51 are guided in the guide slits 43. On both sides of the guide slits 43, support ribs 61 have been formed. The displacement disk 27 rests on these with the helical guide element 29.

As can be seen from FIGS. 4, 5 and 7, two protrusions 71 exist on the guide disk 31. The guides for the support elements 45 with the clamping jaws 15 are conducted past the contour circle of the helical guide disk 57 to the protrusions 71. They rest on these two protrusions and on the handle shoulder in the outermost position 60 of the support elements 45, and the bolt 49 extends into one of the helical guide elements 29 inside the contour circle of the helical guide disk 57.

Figure 8:
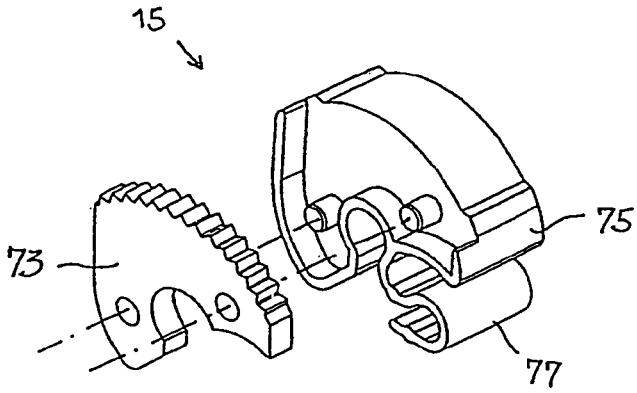
FIG. 8, a perspective representation of an exemplary clamping jaw with spring element and claw, FIG. 9, a perspective representation of the clamping jaw in FIG. 8, viewed from the opposite side.
Figure 9:
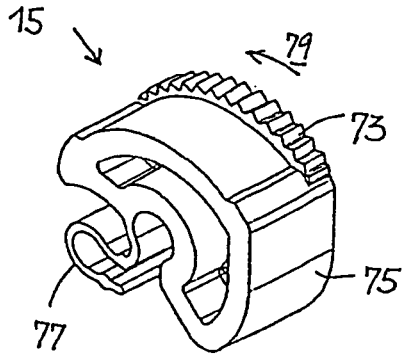
Figure 10:
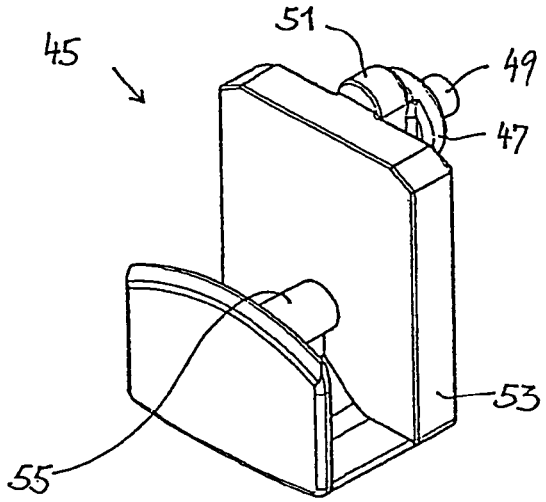
FIG. 10 is a perspective plan view of an exemplary clamping jaw support.
Figure 11:
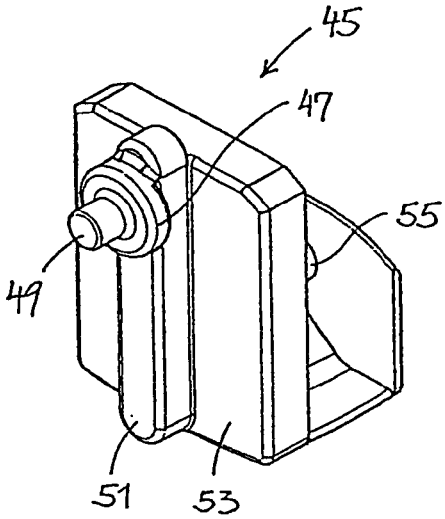
FIG. 11, a second perspective plan view of the clamping jaw support in FIG. 10.

The actual clamping jaws 15 are represented in FIGS. 8 and 9. They have been put together from a metallic claw 73 and a spring element 75 made of a plastic material, in which the claw 73 is supported. The spring element 75 can be clipped to the holding column 55 at the support element 45. An S-shaped spring lip 77 has been formed on the spring element 75, which resiliently gives when under load if the clamping jaw 79 is placed under load in the direction of the arrow 79 during the opening of a screw lid. For this resilient movement, the clamping jaw 15 is pivotable around the holding column 55. The claw 73 has a curvature with teeth, with which it acts on the lid. This curvature has a center circle which is not concentric with the pivot center in the axis of the holding column 55. Therefore the center circle of the curvature is pivoted along, namely in the direction toward the screw lid. A clamping effect between the claw 73 and the screw lid is assured by this.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A screw lid opener comprising:

a handle;

a clamping device for holding a screw lid in place, and having three clamping jaws for clamping down on a screw lid, the clamping jaws being arranged at a distance with respect to a center between the clamping jaws, wherein at least one of the three clamping jaws is movable such that its distance from the center can be changed;

a guide disk that has a linear guide slit and is connected to the handle, and a displacement disk that is rotatable with respect to the guide disk and has at least one helical guide element;

wherein the movable clamping jaw is arranged on a clamping jaw support, the clamping jaw support being movably seated in the linear guide slit of the guide disk;

wherein the clamping jaw support has a guide element, which engages the helical guide element on the displacement disk;

the clamping jaw support acts together with the displacement disk, which can be rotated with respect to the guide disk, such that the distance to the center can be changed by relative rotation between the displacement disk and the guide disk; and wherein the helical guide element is substantially flat in areas in which the clamping jaws are a suitable distance from the center for being able to grip a defined lid radius such that jamming occurs between the helical guide element and the guide element of the clamping jaw support.

2. The screw lid opener in accordance with claim 1, wherein the clamping jaws are asymmetrically disposed and pivotably arranged in the clamping jaw supports such that a load on the clamping jaw occurring when opening a screw lid leads to a pivot movement of the clamping jaw which presses against a screw lid edge.

3. The screw lid opener in accordance with claim 1, wherein a separate helical guide element is provided for each movable clamping jaw support.

4. The screw lid opener in accordance with claim 1, wherein in its course the helical guide element has different gradients and different leads.

5. The screw lid opener in accordance with claim 1, wherein a rotatable handle is connected with the displacement disk.

6. The screw lid opener in accordance with claim 5, wherein the displacement disk is composed of a helical guide disk with a helical guide element and a rotary grip disk with a rotatable handle.

7. The screw lid opener in accordance with claim 6, wherein recesses are provided on one of the disks for connecting the helical guide disk and the rotary grip disk, which are engaged by protrusions on another of the disks.

8. The screw lid opener in accordance with claim 1, wherein each clamping jaw is composed of a spring element made of a plastic material and a claw of metal arranged thereon.

9. The screw lid opener in accordance with claim 8, wherein each clamping jaw can be clipped to a clamping jaw support.

10. The screw lid opener in accordance with claim 9, wherein the clamping jaw support encloses the spring element and claw to inhibit lifting the claw from the spring element by the clamping jaw support.

11. The screw lid opener in accordance with claim 10, wherein a spring lip is formed on the spring element and acts together with the clamping jaw support.

* * * * *